US005305669A

United States Patent [19]

Kimbro et al.

[11] Patent Number: 5,305,669

[45] Date of Patent: Apr. 26, 1994

[54] SHAFT CLAMPING PLIERS

[76] Inventors: Gary A. Kimbro, 1208 Maryland Ave.; Wendell R. Burson, 1034 Pennsylvania Ave., both of St. Cloud, Fla. 34769

[21] Appl. No.: 61,543

[22] Filed: May 17, 1993

[51] Int. Cl.[5] ..... B25B 7/02; B25B 23/00

[52] U.S. Cl. ..... 81/423; 81/426.5; 81/462

[58] Field of Search ..... 81/420–424, 81/424.5, 426.5, 186, 462, 367–384, DIG. 1; 269/268, 270, 278–280, 96, 228

[56] References Cited

U.S. PATENT DOCUMENTS 1,114,649 10/1914 Reed ..... 81/426.5 X 2,595,579 5/1952 Hawkins ..... 81/379

3,907,269 9/1975 Baker, Jr. ..... 269/96 X 4,297,756 11/1981 Lance ..... 81/367 X

*Primary Examiner*—D. S. Meislin

*Attorney, Agent, or Firm*—Leon Gilden

[57] ABSTRACT

A locking plier structure arranged to secure a shaft includes facing movable semi-cylindrical inserts mounted relative to respective fixed movable jaws of the plier structure such that the movable jaw includes fixedly mounted thereto a support shaft secured in turn to a support plate. The support shaft is optionally arranged to pivotally mount relative to the support plate permitting angular orientation of a workpiece clamped by the plier structure.

2 Claims, 4 Drawing Sheets

PROIR ART

FIG. 5
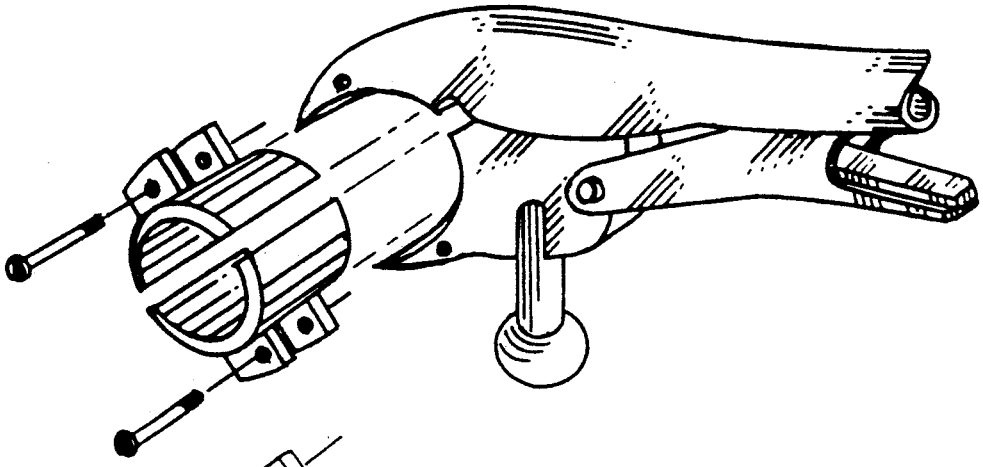
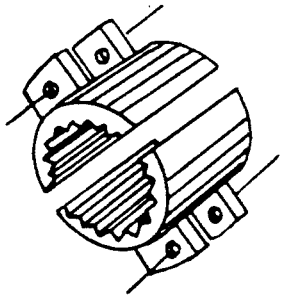
FIG. 6
FIG. 7
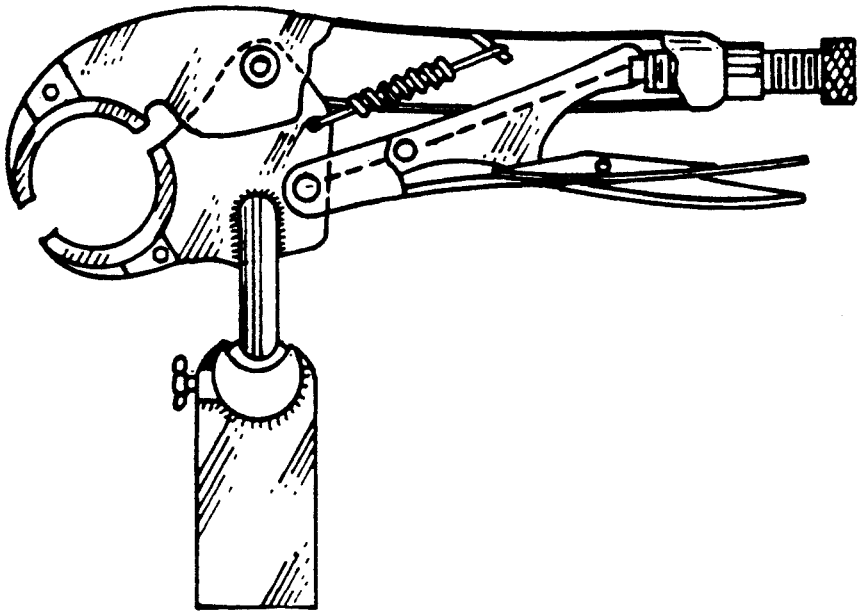

SHAFT CLAMPING PLIERS

BACKGROUND OF THE INVENTION

1. Field of the Invention

The field of invention relates to locking plier structure, and more particularly pertains to a new and improved shaft clamping pliers wherein the same is directed to the securement of a shaft member relative to working relative to the shaft.

2. Description of the Prior Art

The clamping of a clamp structure such as desired relative to a conventional shaft supported weed trimming apparatus is awkward and cumbersome due to the conventional positioning of the weed trimming motor at an end portion of the workpiece shaft. To secure such a shaft workpiece without use of a counterbalance, the instant invention is directed to a clamping plier structure wherein the same employs the use of locking pliers having a support shaft structure that in turn is secured between a vise assembly and in this respect, the present invention substantially fulfills this need.

Examples of prior art locking pliers are indicated in U.S. Pat. Nos. 3,958,468; 3,545,316; and 4,889,022.

SUMMARY OF THE INVENTION

In view of the foregoing disadvantages inherent in the known types of clamping plier apparatus now present in the prior art, the present invention provides shaft clamping pliers wherein the same is directed to the securement of a shaft between confronting jaws of a toggle wrench operative plier arrangement. As such, the general purpose of the present invention, which will be described subsequently in greater detail, is to provide a new and improved shaft clamping pliers which has all the advantages of the prior art clamping plier apparatus and none of the disadvantages.

To attain this, the present invention provides a locking plier structure arranged to secure a shaft, including facing movable semi-cylindrical inserts mounted relative to respective fixed movable jaws of the pliers structure such that the movable jaw includes fixedly mounted thereto a support shaft secured in turn to a support plate. The support shaft is optionally arranged to pivotally mount relative to the support plate permitting angular orientation of a workpiece clamped by the plier structure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved shaft clamping pliers which has all the advantages of the prior art clamping plier apparatus and none of the disadvantages.

It is another object of the present invention to provide a new and improved shaft clamping pliers which may be easily and efficiently manufactured and marketed.

It is a further object of the present invention to provide a new and improved shaft clamping pliers which is of a durable and reliable construction.

An even further object of the present invention is to provide a new and improved shaft clamping pliers which is susceptible of a low cost of manufacture with regard to both materials and labor, and which accordingly is then susceptible of low prices of sale to the consuming public, thereby making such shaft clamping pliers economically available to the buying public.

Still yet another object of the present invention is to provide a new and improved shaft clamping pliers which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is an isometric illustration of the plier structure including replaceable jaw inserts.

FIG. 6 is an isometric view of a replacement jaw insert structure.

FIG. 7 is an orthographic side view of the plier structure mounted in an adjustable relationship relative to the associated support plate structure, as indicated in FIG. 4.

DESCRIPTION OF THE PREFERRED EMBODIMENT

Figure 1:
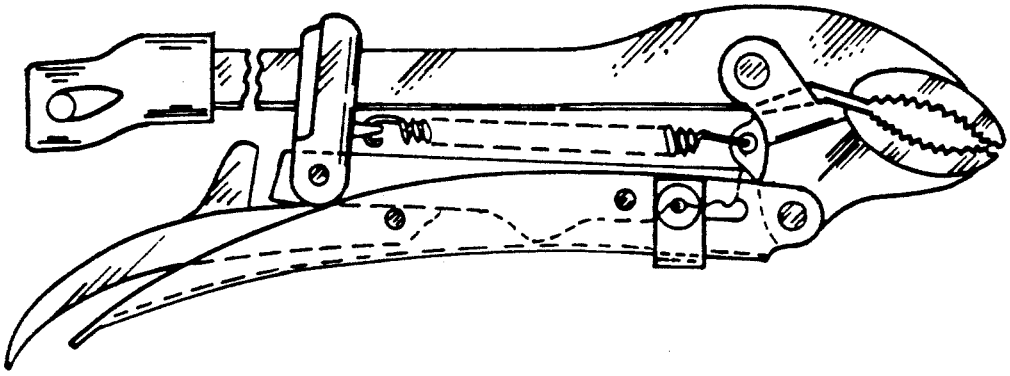
FIG. 1 is an orthographic view of a prior art toggling type plier structure, as indicated in the U.S. Pat. No. 3,545,316.
Figure 2:
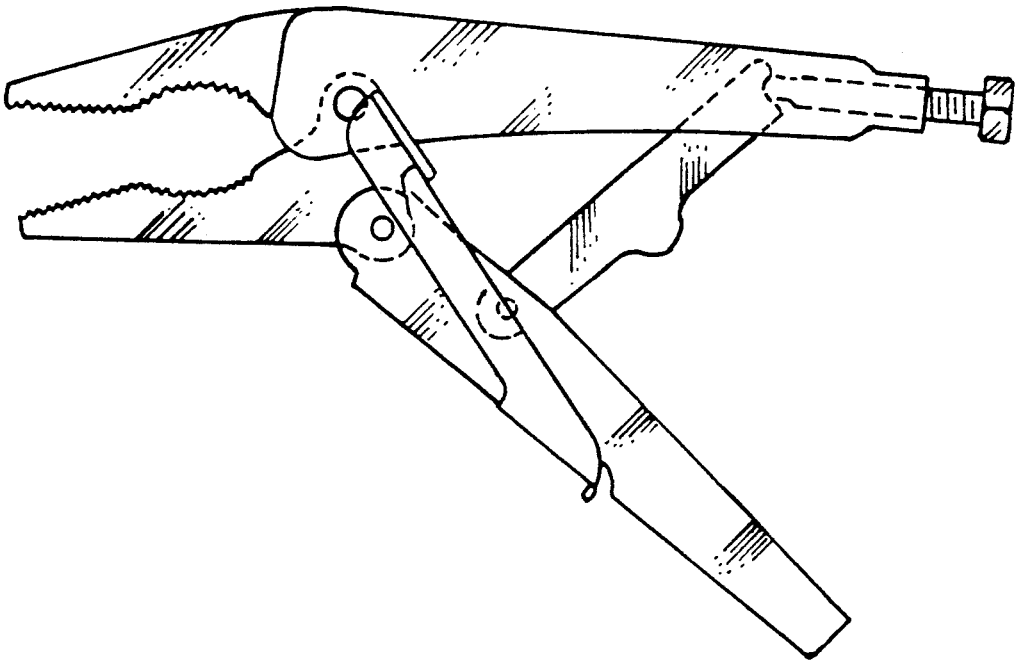
FIG. 2 is an orthographic side view of a further example of a prior art shaft clamping plier arrangement as indicated in U.S. Pat. No. 4,889,022.

With reference now to the drawings, and in particular to FIGS. 1 to 7 thereof, a new and improved shaft clamping pliers embodying the principles and concepts of the present invention and generally designated by the reference numeral 10 will be described.

More specifically, the shaft clamping pliers 10 of the instant invention (see FIG. 3) includes a fixed handle 11 cooperative with a movable handle 12, with the fixed handle 11 including a fixed jaw 13, while the movable handle 12 is pivotally mounted about a movable handle pivot 17 to a movable jaw 14, that in turn is mounted pivotally by a jaw pivot axis 15 to the fixed jaw 13, in a manner as indicated and exemplified by the U.S. Pat. No. 3,958,468 incorporated herein by reference.

The fixed jaw 13 is provided with a fixed jaw semi-cylindrical face 18 arranged in a facing relationship relative to a movable jaw semi-cylindrical face 19 of the movable jaw 14. A first mounting bore 20 is directed through the fixed jaw, while a second mounting bore 21 is directed through the movable jaw, with the first and second mounting bores arranged in a parallel relationship. A first insert 22 of a semi-cylindrical configuration is complementarily received within the fixed jaw semi-cylindrical face 18, while in a like manner a second insert 23 of a semi-cylindrical configuration is received complementarily within the movable jaw semi-cylindrical face 19. First insert mounting flanges 24 receive the fixed jaw 13 therebetween, while second insert mounting flanges 25 parallel relative to one another receive the movable jaw 14 therebetween, while a first fastener rod 26 is directed through the first mounting flanges 24 and through the first mounting bore 20, while a second fastener rod 27 is directed through the second insert mounting flanges 25 and the second mounting bore 21 (see FIG. 5). Further, replacement inserts such as third and fourth inserts 28 and 29 may be provided such as having various ribbed concave faces to provide for various sizing between the facing inserts in a clamping of a tubular workpiece, in a manner as indicated in FIG. 3.

Figure 3:
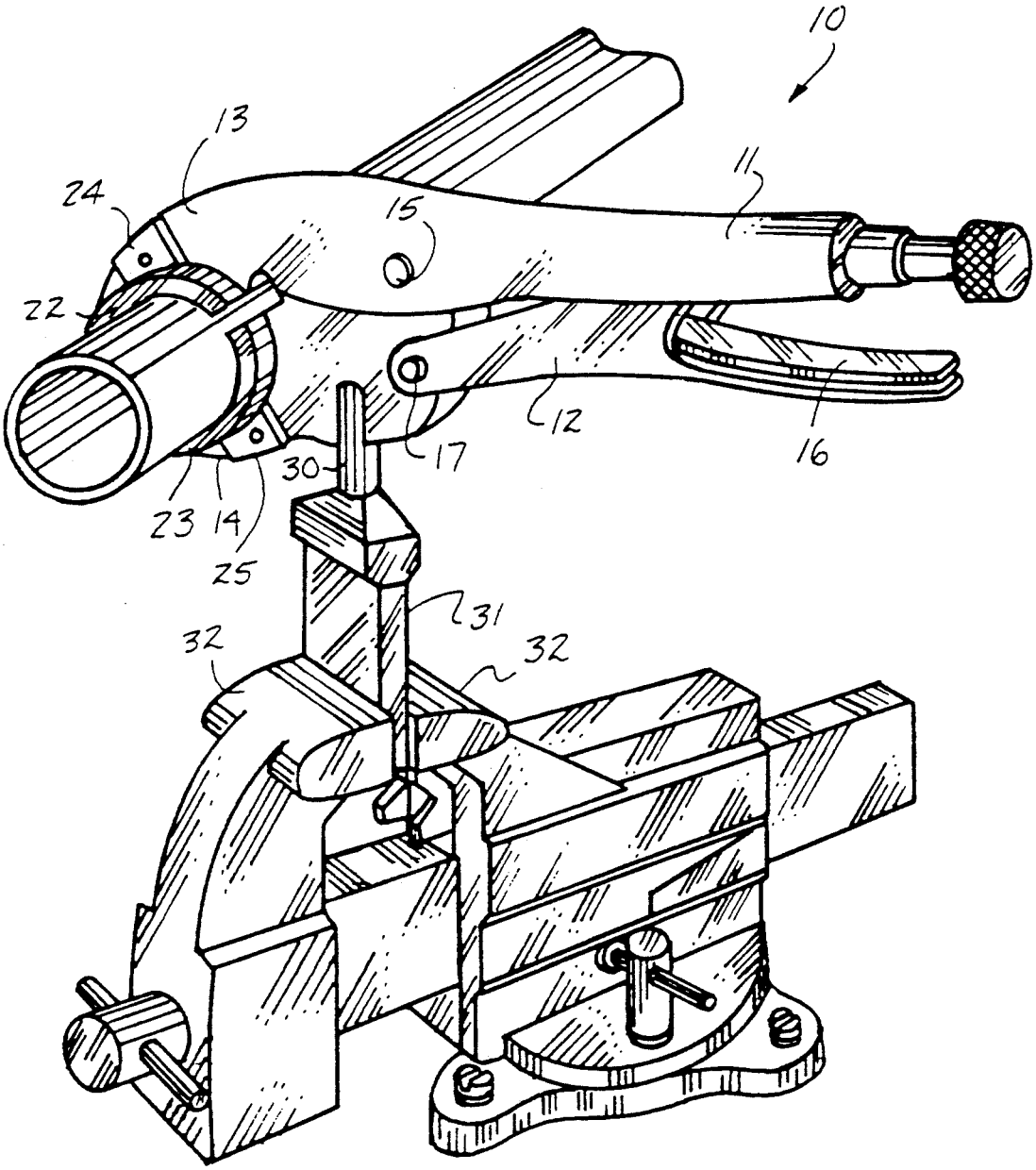
FIG. 3 is an isometric illustration of the invention.

As illustrated in FIG. 3, a rigid support shaft 30 is fixedly mounted to the movable jaw 14, with the support shaft 30 longitudinally aligned and fixedly mounted to support plate 31 that is spaced from the movable jaw such that the support plate 31 is arranged for clamping between cooperative and facing clamping vise jaws 32 of an associated vise organization, as indicated in FIG. 3, that in turn is mounted upon a rotatable vise base 33, wherein in this manner, the cooperation of the components provides for not only rotative orientation of the workpiece but fixed clamping of the workpiece not requiring counterbalancing in the securement of the workpiece relative to the organization.

Figure 4:
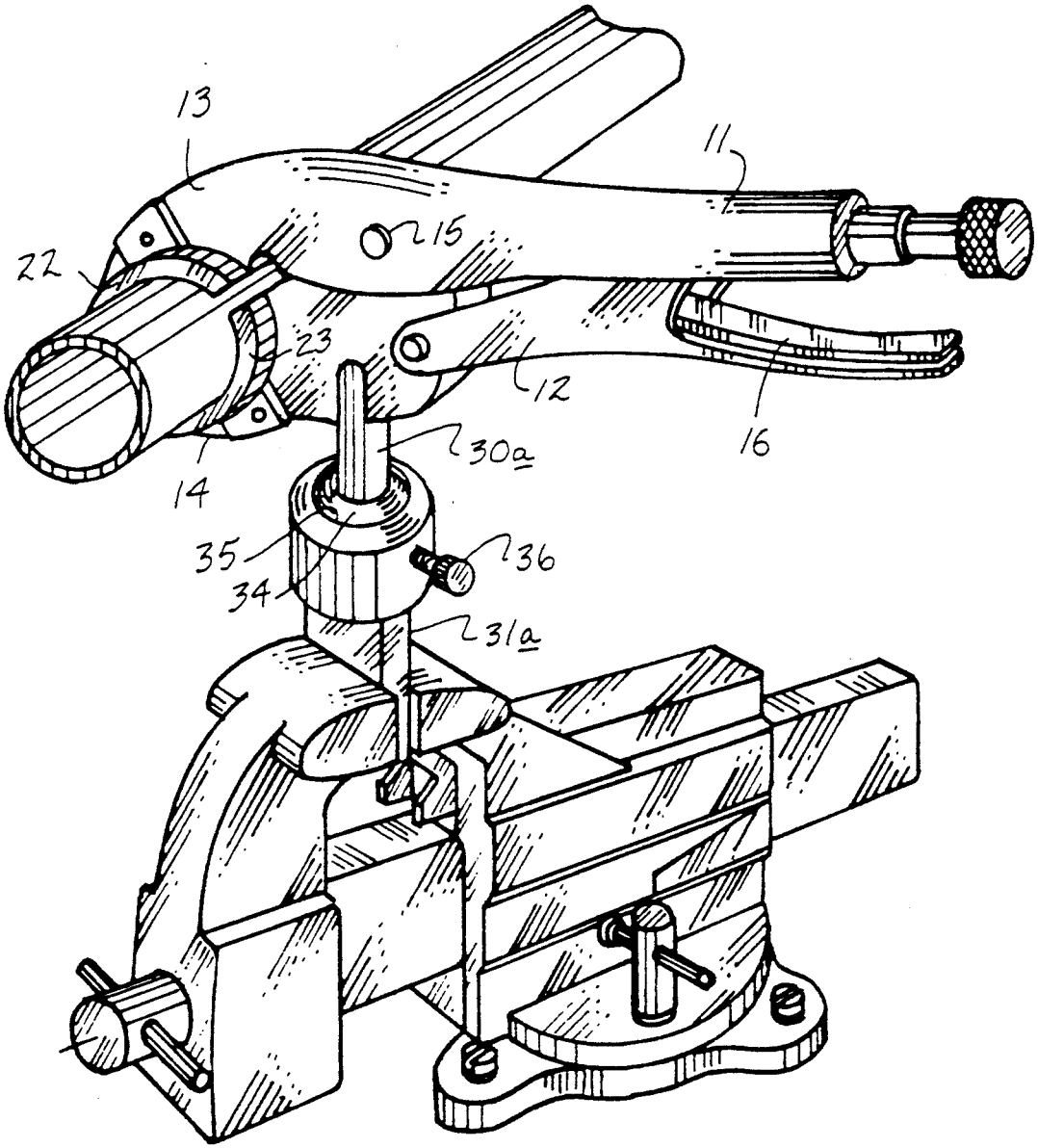
FIG. 4 is an isometric indication of the invention having the support shaft adjustably mounted relative to an underlying support plate.

The FIGS. 4 and 5 exemplify a modified support shaft 30*a* mounted to a modified support plate 31*a* such that the modified support shaft 30*a* includes a pivot sphere 34 at its lowermost end spaced from the movable jaw, such that pivot sphere 34 is complementarily received within a pivot sphere socket 35 within the support plate 31, with a locking screw 36 directed through the support plate 31*a* and received within the pivot sphere socket 35 for engaging the pivot sphere 34 to provide for locking of the pivot sphere relative to the socket 35 and permitting the angular orientation of the plier arrangement relative to the underlying vise structure.

It should be understood that the support shaft is orthogonally oriented relative to the jaw pivot axle as well as the movable handle pivot axle in projecting beyond the movable jaw to properly orient the first and second inserts in a desired orientation relative to the underlying vise structure. It should also be noted that in the construction of the support plate 31, the support plate includes support plate side walls, as illustrated, that are arranged in a spaced parallel relationship relative to one another to accommodate secured clamping between the vise jaws 31, as illustrated in FIG. 3 for example.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. Shaft clamping pliers, comprising, a plier assembly having a fixed handle, with the fixed handle including a fixed jaw, the fixed jaw including a fixed jaw semi-cylindrical face, and a movable handle, the movable handle having a movable jaw, with the movable jaw and the movable handle interconnected by a movable handle pivot axle, the movable jaw pivotally attached to the fixed jaw about a jaw pivot axle, with the movable jaw having a movable jaw semi-cylindrical face in a facing confronting relationship relative to the fixed jaw, and a first insert secured to the fixed jaw and a second insert secured to the movable jaw, and the first insert includes a first semi-cylindrical body complementarily received within the fixed jaw semi-cylindrical face, with the first insert further including a plurality of first insert mounting flanges arranged in a parallel relationship relative to one another receiving the fixed jaw therebetween, and the second insert including a second insert semi-cylindrical body having spaced parallel second mounting flanges, with the second mounting flanges receiving the movable jaw therebetween, and the fixed jaw having a first mounting bore, the movable jaw having a second bore, and a first fastener rod directed through the first insert flanges and the first mounting bore, and a second fastener rod directed through the second mounting flanges and the second mounting bore, with the first mounting bore and the second mounting bore arranged in a parallel relationship relative to one another, and a support shaft fixedly mounted to the movable jaw orthogonally oriented relative to the jaw pivot axle and the movable handle pivot axle, with the support shaft having a support shaft first and secured to the movable jaw and a support shaft second end, and a support plate, with the support plate mounted to the support shaft at the support shaft second end, and the support shaft second end includes a pivot sphere, and the support plate includes a support plate socket, the support plate socket complementarily and rotatably receives the pivot sphere, and a locking rod threadedly directed through the pivot sphere socket in engagement with the pivot sphere within the pivot sphere socket to clampingly secure the pivot sphere relative to the pivot sphere socket.

2. A clamping plier arrangement as set forth in claim 1 wherein the support plate includes spaced planar side walls, and the spaced planar side walls are arranged in a parallel orientation relative to one another.

* * * * *